US005623291A

United States Patent [19]

Morandotti et al.

[11] Patent Number: 5,623,291

[45] Date of Patent: Apr. 22, 1997

[54] MEASURING APPARATUS FOR THE INK-LEVEL IN INK-JET PRINTING UNIT

[75] Inventors: Roberto Morandotti, Mercenasco; Alessandro Scardovi, Ivrea, both of Italy

[73] Assignee: Olivetti-Canon Industriale S.p.A., Ivrea, Italy

[21] Appl. No.: 354,028

[22] Filed: Dec. 6, 1994

[30] Foreign Application Priority Data

Dec. 16, 1993 [IT] Italy ..... TO93A0953

[51] Int. Cl.[6] ..... B41J 2/195; B41J 2/175

[52] U.S. Cl. ..... 347/7; 347/87; 347/93

[58] Field of Search ..... 347/7, 85, 86, 347/87, 83; 73/304 R, 290 R; 346/140.1; 406/223

[56] References Cited

U.S. PATENT DOCUMENTS

| | | | |
|---|---|---|---|
| 4,183,029 | 1/1980 | Isayama et al. | 346/140 R |
| 4,196,625 | 4/1980 | Kern | 73/304 R |
| 4,202,267 | 5/1980 | Heinzl et al. | 101/364 |
| 5,051,759 | 9/1991 | Karita et al. | 346/140 R |
| 5,070,346 | 12/1991 | Mochizuki et al. | 346/140 R |
| 5,136,305 | 8/1992 | Ims | 346/1.1 |
| 5,162,817 | 11/1992 | Tajika et al. | 346/140 R |
| 5,289,211 | 2/1994 | Morandotti et al. | 347/7 |
| 5,289,212 | 2/1994 | Carlotta | 347/87 |

OTHER PUBLICATIONS

Patent Abstracts of Japan, vol. 16, No. 477 (M–1320), Oct. 05, 1992, JP 04/173,251.

Patent Abstracts of Japan, vol. 15, No. 505 (M–1194), Dec. 20, 1991, JP 03/222,755.

Patent Abstracts of Japan, vol. 11, No. 234, (M–611) [2681], Jun. 30, 1987, JP 62/046,650.

Patent Abstracts of Japan, vol. 8, No. 144 (P–284), Jul. 5, 1984, JP 59/043,340.

Patent Abstracts of Japan, vol. 16, No. 494 (M–1324), Oct. 13, 1992, JP 04/182,141.

Patent Abstracts of Japan, vol. 17, No. 83 (M–1369), Feb. 18, 1993, JP 04/282,256.

*Primary Examiner*—Benjamin R. Fuller
*Assistant Examiner*—Craig A. Hallacher
*Attorney, Agent, or Firm*—Banner & Witcoff, Ltd.

[57] ABSTRACT

In an ink-jet printing unit comprising a printing head mounted on the container, a measuring circuit comprising a pair of electrodes which substantially enclose the volume of ink within the container, allows hysteresis- free linear mode measurement of variations in the ink volume within the container and the signalling of at least one of the ends of the variation interval to indicate the most suitable moment for recharging ink in the container by means of a cartridge inserted into the container.

11 Claims, 3 Drawing Sheets

MEASURING APPARATUS FOR THE INK-LEVEL IN INK-JET PRINTING UNIT

FIELD OF THE INVENTION

The present invention relates to a measuring apparatus for the ink-level in ink-jet printing unit and more particularly to a measuring apparatus for the ink-level in an ink-jet thermal printing unit comprising an ink-jet thermal printing head integral with the reservoir which is repeatedly rechargeable, whenever the ink has dropped to a pre-determined volume.

The recharging may be carried out by means of a syringe, or by means of a small capacity cartridge compared with that of the reservoir, as described in European Patent Application No. 94306684.5 in the name of the applicant.

BACKGROUND OF THE INVENTION

End of ink detection apparatus are known in the art for printing units and more generally for ink-jet printing heads.

In particular U.S. Pat. No. 4,183,029 describes a detection apparatus showing the end of ink flow in the duct between the reservoir and the printing-head, due to an obstruction therein, caused by an air bubble or an impurity.

U.S. Pat. No. 5,051,759 describes an ink-end detector, in which two electrodes are fitted in the sponge located in the container and impregnated with ink. The electrodes are connected to a detector circuit that measures the electrical resistance of the ink placed between the electrodes. As known, as the ink is consumed, the sponge progressively empties from one end to the other where the electrodes are fitted.

However the ink resistance does not vary extensively until the level of the ink reaches the zone of the electrodes, then rapidly increases thereafter.

U.S. Pat. No. 5,136,305 describes a similar end of ink detector, whereby a thermistor is inserted into the sponge, in contact with the ink and receiving a d.c. supply. Measurement of the temperature increase of the thermistor represents the reduction in volume of ink in the sponge.

U.S. Pat. No. 5,162,817 describes an end of ink detector for an ink-jet printing head fed by a replaceable cartridge. The head comprises its own reservoir complete with an ink-impregnated sponge, onto which the cartridge can be coupled.

The detector comprises three electrodes fitted in the sponge and selected in pairs for detection with the head in the horizontal or the vertical position.

European Patent Application No. 440 110 describes another end of ink detector for another ink-jet printer whereby the container containing an ink-impregnated sponge can be replaced and connected to the head by means of a hollow needle penetrating the reservoir.

The reservoir has two electrodes, one fitted in the sponge, and the other inserted in the feed duct to the head. The detection circuit comprises a compensation resistance for the ink-viscosity according to the temperature.

All of the end of ink detector apparatus outlined above have one similar characteristic in common. i.e. that the ink reservoir contains a sponge, with the electrodes fitted therein close to the ink outlet hole. For that reason the end of ink signal obtained as a function of the variation in resistance of the ink between electrodes, is only generated when a small volume of ink remains in the reservoir, representing approximately 15% of the total, corresponding to a consumption of approximately 85% of the available volume.

This is due to the fact that the curve (FIG. 1) for ink resistance $R_k$ variation between electrodes, as a function of the ink consumption S% is essentially flat until the ink-consumption S% reaches approximately 85% of the total, as previously stated, before suddenly rising beyond that value.

Such apparatus are nevertheless not able to indicate continuous variations in the quantity of ink contained in the reservoir in an intermediate zone between minimum and maximum ink content.

SUMMARY OF THE INVENTION

Preferred embodiments of the present invention thus may comprise means to measure the ink-level in a rechargeable unit, able to signal at least one of the extremes, preferably the lower end of an ink-volume variation range, comprised between the minimum remaining volume and the maximum remaining volume in the reservoir, thus allowing with sufficient precision to determine the moment when the reservoir needs refill with a predetermined volume of ink.

The invention is characterised in the manner defined in the main claim.

That and other characteristics of the invention are more clearly discerned from the following description of a preferred form of execution, given for the purposes of a non-restrictive example, and referring to the appended drawings.

DETAILED DESCRIPTION OF THE INVENTION

Figure 2:
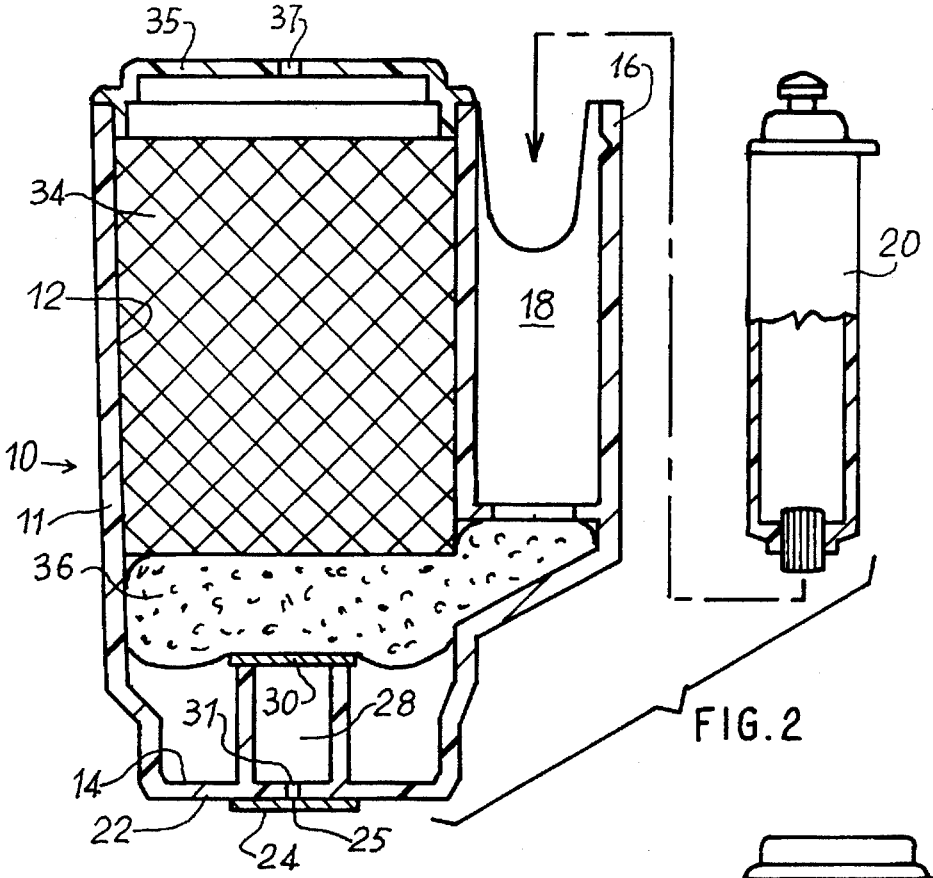
FIG. 2 represents an ink-jet printing unit adapted for mounting a measuring apparatus embodying the invention.

FIG. 2 represents as a non-restrictive application example of the invention, a printer rechargeable unit 10 of the type described in the European Patent Application 94306684.5 in the name of the Applicant, which consists of a main structure 11, comprising a container 12 for the ink and an auxiliary structure 16 integral with the main structure 11 and comprising an aperture 18 to admit the refill cartridge 20, inserted in the aperture 18 when the ink in the container 12 has reached a predetermined minimum level.

The container 12 is defined at the bottom by a wall 14 on the outer face 22 of which an ink-jet thermal printing head 24 is mounted. The print- head consists of an integrated circuit technique silicon chip, including a plurality of nozzles 25, the relevant emission chambers and relevant emission resistors, not visible in the figure.

On the inside of the container 12 a feed chamber 28 is located closed at the top by a diaphragm 30 permeable to the ink, but not to air, and communicating with the print-head 24 through a duct 31 passing through a bottom wall 14.

The container 12 is filled with absorbent material 34 such as for instance a fibre or felt agglomerate, or a pack of layers of non woven textile (TNT), which is impregnated with ink at the time of assembly of the unit.

After filling with ink, the container 12 is closed in a stable manner with a cover 35 having an aperture 37 to vent the container 12 to atmospheric pressure.

During the filling of the container 12, particular care is taken to ensure that the ink completely fills the chamber 28, the duct 31 and the emission chambers of the print-head 24, so as to ensure its satisfactory operation.

According to a preferred non-restrictive form of design of the print-head, the absorbent material 34 consist of a pack of sheets or layers of non-woven textile, a material known in the state of the art, and sold under various names according to the nature of the base material, as for instance:

Reemay (Reemay Inc registered trademark):polyester

Tekton (Reemay Inc registered trademark):polypropylene

Sontara (Du Pont registered trademark) :polyester

Nordlys (Nordlys Inc registered trademark):polyamide

These materials consist of one or several layers of synthetic fibre placed at random one on top of the other, and bonded together at contact points, so as to form a flat structure like a sheet.

The sheets cut to the required dimensions are stacked in clearly defined numbers, so as to form a pack which is then inserted into the container 12; as an alterative the pack may be obtained by folding like an accordion a sheet of the material of the required height.

In each case, the number of layers forming the pack must be accurately defined, since any variation of that number (for a same thickness of sheet) produces a greater or lesser level of fibre compression and of consequent control over the available capillarity.

Between the pack 34 of non-woven sheet and the diaphragm 30 a layer of slightly compressed spongy material 36 is inserted, intended by its capillarity to ensure the flow of ink towards the chamber 28, through the diaphragm 30.

In the case of a small size printing unit 10, for instance suitable to be inserted in a portable or low-end ink-jet printer, able to contain approximately 5–6 $cm^3$ of ink, the duration of the ink is notably shorter than the life of the print-head 24.

Thus in order to avoid throwing away the empty unit with a still efficient head 24, the unit 10 is arranged so as to admit a refill cartridge 20, easily inserted to recharge the container 12 with new ink, and easily removable when the refilling is completed.

It is consequently necessary to know with sufficient accuracy the minimum remaining ink level in the container 12 of the unit 10, following which the refill cartridge has to be inserted into the aperture 18 to provide a new ink supply.

According to tests carried out it has proved useful to refill the unit 10 when the remaining volume of ink in the container 12 has dropped to approximately one third of the total capacity of the container 12.

Figure 4:
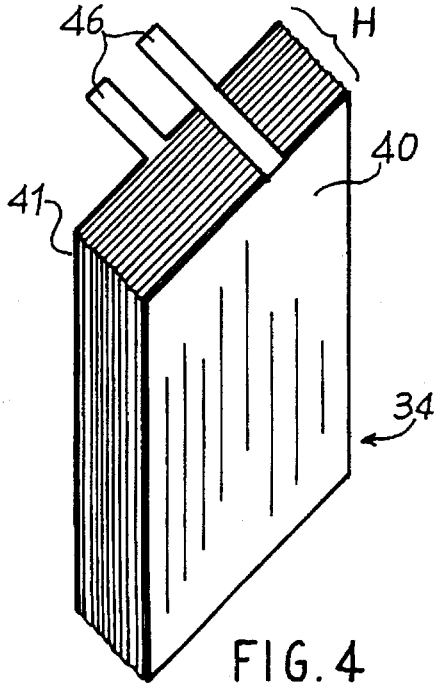
FIG. 4 represents a fibre pack located between two electrodes and contained within the unit in FIG. 2.
Figure 3:
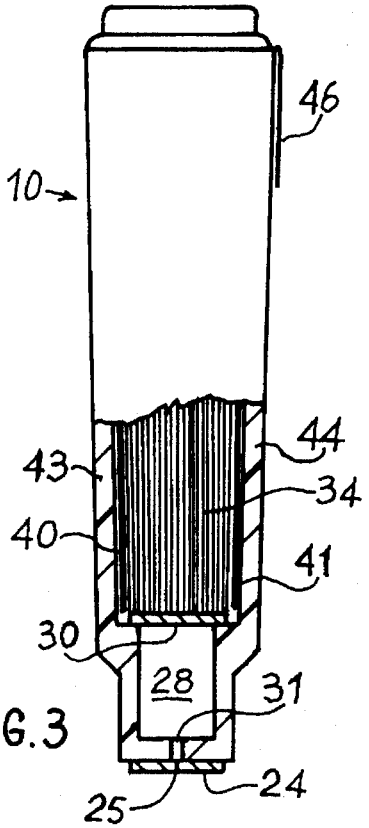
FIG. 3 represents a section along III—III in FIG. 2.

For that purpose two metal plates 40, 41 are placed in the container 12 (FIGS. 3 & 4) against respectively opposing walls 43, 44 and including between them the pack 34 of fibrous material. The size of plates 40, 41 is such as to cover completely the largest faces of the pack 34 (FIG. 4) and serve as electrodes in contact with the ink to detect the level of ink contained in the container 12, as will be explained further on, and may be made of stainless steel or gold-plated copper, or any other electrically conductive material which withstands chemical attack by the ink.

The electrodes 40, 41 may also be designed as a sufficiently close-meshed grid, or netting or mesh of one of the previously defined materials.

To facilitate insertion of the pack 34 and plates or electrodes 40, 41 in the container 12, a block (FIG. 4) is firstly prepared consisting of pack 34 included between the electrodes 40, 41, cut to measure, in such a manner as to allow its easy single-operation insertion into the container.

Figure 6:
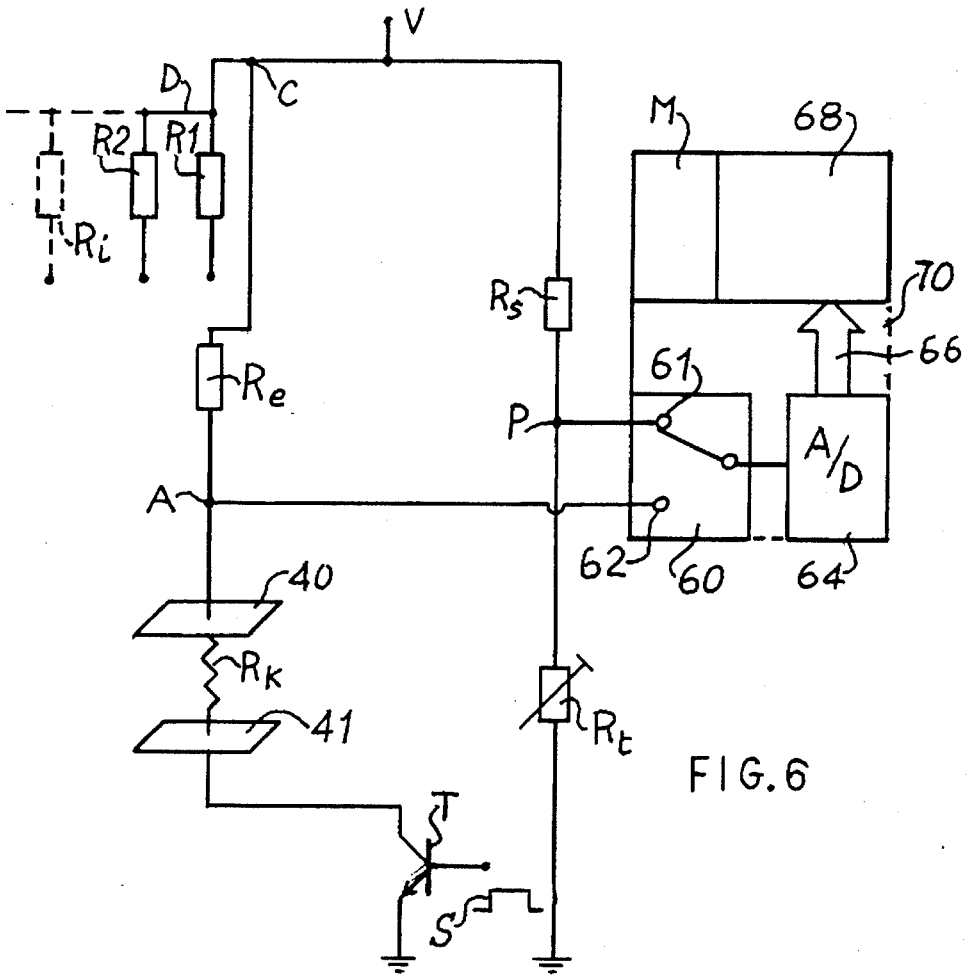
FIG. 6 represents an electrical circuit for measuring the ink level in an embodiment of the invention.

Each of the electrodes 40, 41 has a fin 46 projecting outside the container 12 (FIG. 3) forming an electrical terminal for connection to a detection circuit (FIG. 6) described further on.

Figure 5:
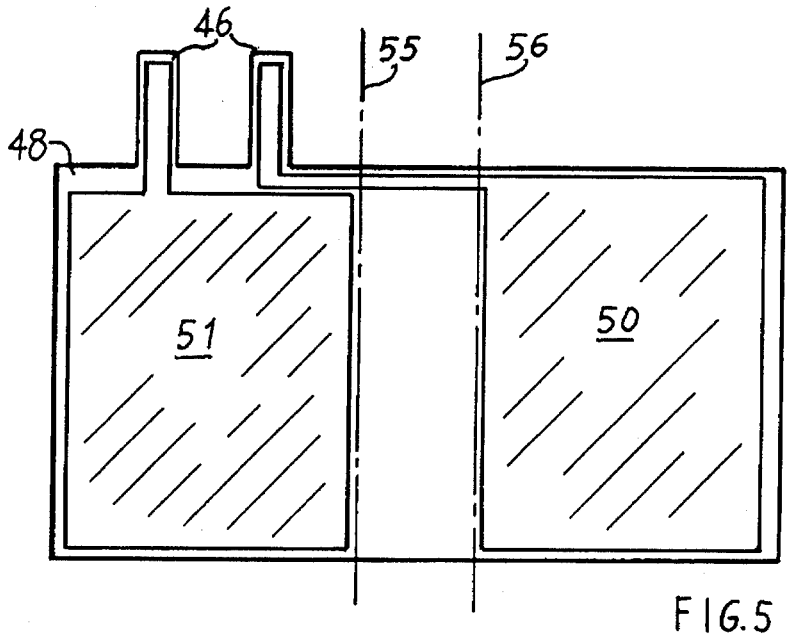
FIG. 5 represents a second embodiment of the electrodes in FIG. 4.

FIG. 5 shows a different embodiment of the electrodes 40, 41, designed in the form of a flexible film (flat cable) 48 on which two metal zones 50, 51 are deposited, each connected to an electrical terminal and extending in such a manner as to be superimposed completely over the flat faces of the fibre pack 34. The film 48 may consist for instance of MYLAR (Registered trademark) or some other material having the same properties. The film 48 is folded at right angles to match lines 55, 56 then wound onto pack 34 so as to fully superimpose the metal zones 50, 51 on opposing faces of the pack 34.

The distance between lines 55, 56 obviously coincides with the thickness H (FIG. 4) of the pack 34. The group consisting of the pack 34 and film 48 is then inserted into the container 12.

As an alternative the electrodes 40, 41 may be produced by silk-screen printing technique featuring a layer of electrically conductive and chemically inert material deposited on the inner face of two opposing walls 43, 44 of the container 12.

Figure 1:
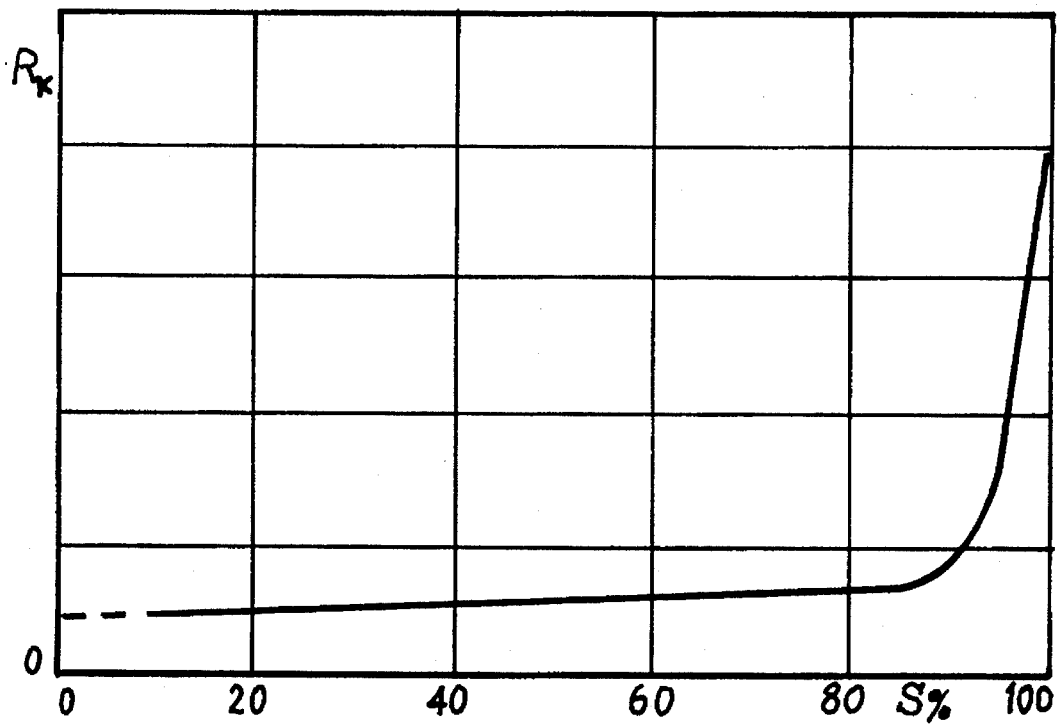
FIG. 1 represents a typical resistance variation curve for the ink between two electrodes, as known in the present art.
Figure 7:
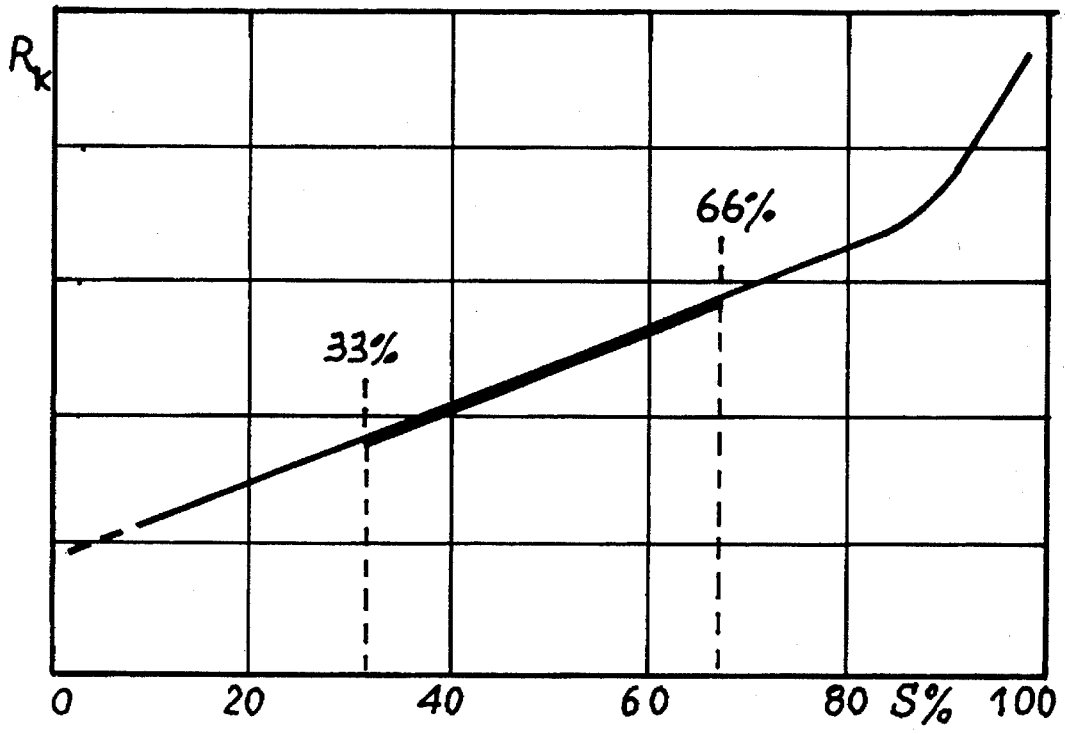
FIG. 7 represents a variation curve for the ink resistance, obtained by means of the apparatus embodying the invention.

In that way it is possible to measure by volumetric method the electrical resistance $R_k$ of the ink, the extension of the electrodes being such as to cover the whole of the volume of ink contained in the pack 34 and fully interposed between electrodes 40, 41. The resistance $R_k$ varies in inverse proportion with the volume (or with the level, assuming an equal section) according to a sufficiently accurate law for up to about 80% of the ink contained in the container 12. In FIG. 7 the abscissae S% represent the % consumption of the total ink in the container.

Furthermore the ink resistance variations show no significant hysteresis, and measurement of the ink level can be repeated several times with good accuracy.

In a small size printing unit, i.e. capable of containing 5–6 $cm^3$ of ink and rechargeable by way of a cartridge, as shown in FIG. 2, to ensure a degree of repetitive and constant filling, it has been found that refilling with new ink can be suitably effected when the ink consumption S% has reached approximately 2/3rds (66%) of the available ink in the container 12 (FIG. 7), or in other words when a minimum quantity of 25% to 40% of ink remains in the container and preferably of the order of 33% of the maximum admissible volume.

In that event the volume of ink which can be added in an optimum manner, i.e. in the shortest possible time and uniformly impregnating the absorbent Material 34, is of the order of 1/3rd of the total, viz. approximately 2 $cm^3$.

As already stated previously, it is extremely difficult with the known means to detect the ink-end with the required accuracy, when the ink reaches a level of 33% in the container 12. The measurement of the ink level in the container 12 is thus effected according to the embodiment of the invention, by means of the circuit in FIG. 6 associated with the electrodes 40, 41 located within that container.

Two resistors Rs and Rt in series form a resistive voltage divider connected between the supply voltage V and earth M. An intermediate point P between the two resistors is connected to a first input 61 of a switch 60. A second input 62 of the switch 60 is connected at a point A to one of the two electrodes, for instance to electrode 40.

The other electrode 41 is connected to earth M through a transistor T, which connects electrode 41 to earth for brief moments only, in response to a signal S, to avoid any ink electrolysis phenomenon.

The first electrode 40 is also connected at point A to a resistor Re in turn connected to the voltage supply V. Resistor Re functions as a balancing and compensation resistance for several resistance values of differing inks, as may be seen further on.

The switch 60 is connected to an analog/digital converter (A/D) 64 which in turn is connected by a bus 66 to a microprocessor 68. The switch 60 is preferably integrated, together with the A/D converter 64 and the microprocessor 68 in a single integrated circuit chip 70. The microprocessor 68 processes the voltage values recorded at points P and A each time the transistor T is activated by the signal S from the microprocessor 68.

It is known that temperature variations affect the resistivity of the ink and that each type of ink has its own resistivity which may vary considerably from one type of ink to another. The apparatus according to the invention is preset to allow for the said variations and compensate them as described further on. For a given type of ink, the resistivity variation versus the temperature is mainly caused by the differing ionic mobility of the ink base solution, as represented by a typical temperature coefficient "$c_t$", which, as an example, may be: 0.013 in the temperature range between 10° and 60° C.

To compensate such ink resistivity variations with temperature, the resistor Rt is therefore preferably a thermistor having the same temperature coefficient "$c_t$" as the ink, so that the voltage at point P (threshold value) also varies with the temperature. However when a different type of ink is to be used, for instance of differing composition or having other chromatic characteristics, and thereby a different resistivity, the latter is compensated after assigning a specific value to the resistance Re.

As a non-restrictive example, the resistivity of a given type of ink measured between electrodes 40, 41 is 100 ohms when the container is full, whilst after consumption of approximately 2/3rds of the total, that resistivity has increased to 500 ohms. A resistor Re is then selected for that type of ink, with a value of 500 ohms, when the ink level has dropped to the value shown above, the voltage at point A being V/2.

The resistor Re may have, of course, other values allocated to it, without limiting the scope of the present invention.

To simplify the design of the apparatus according to the invention, the resistor Re may be directly integrated in the silicon chip 24, at well as the emission resistors R, R2 . . . Ri. In that case, since a terminal C of resistor Re is connected to the supply V, the common supply track D, already present in chip 24, can save an external connection.

During operation, each time the transistor T is activated, the microprocessor 68 records the voltage value at point A and, after triggering switching of the switch 60, proceeds with a comparison with the voltage at point P, already temperature—compensated by resistance Rt. As soon as the voltage at point A reaches the anticipated value V/2, the microprocessor generates a signal, non specifically shown here, to activate an alarm apparatus in a known manner, to indicate to the operator that the ink supply must be refilled.

As an alternative, the resistor Rt may be a normal temperature sensor disassociated from the particular value of the ink temperature coefficient "$c_t$" and fixed to the unit 10 as nearest as possible to the print-head 24. In this event, the microprocessor 68 records the temperature of the ink and, using a conversion table stored in part of the memory M of the microprocessor 68, calculates an equivalent threshold voltage, to which the voltage at point A is compared.

It should of course be understood that variations, modifications or replacement of parts may be made in connection with the present apparatus to measure the ink-level in an ink-jet printing unit, without in any way diverting from the scope of the invention as defined by the appended claims.

What it is claimed is:

1. Apparatus for measuring ink level in an ink-jet printing unit, comprising:

a print-head;

a container integral with said print-head containing a volume of ink of a typical resistivity, said container including a pair of opposite walls separated by a distance; and a pair of electrodes located inside said container, each electrode of said pair of electrodes comprising a flat plate secured to a corresponding wall of said pair of opposite walls, said plate being made of an electrically conductive and chemically inert material with reference to said ink, whereby said pair of electrodes is separated by said distance.

2. Apparatus according to claim 1, wherein said container is filled with a pack of fibrous material impregnated with said ink, said pack comprising a plurality of sheets or layers of non-woven textile packed to a predetermined thickness.

3. Apparatus according to claim 2, wherein said distance separating said pair of electrodes is substantially equal to said thickness of said pack of fibrous material, and said pair of electrodes has a surface completely covering end faces of said pack.

4. Apparatus according to claim 2, wherein said pair of electrodes comprises a layer of an electrically conductive material deposited on a thin film of insulating and inert material wound around said pack of fibrous material.

5. Apparatus according to claim 1, wherein said pair of electrodes comprises a metal mesh component.

6. Apparatus according to claim 1, wherein said pair of electrodes comprises a thin layer of an electrically conductive and chemically inert material with reference to said ink, deposited by a silk-screen printing technique onto said corresponding wall of said pair of opposite walls of said container.

7. Apparatus according to claim 1, further comprising a measuring circuit for measuring said ink level in said container, wherein said pair of electrodes is connected to said measuring circuit.

8. Apparatus according to claim 7, in which said print-head comprises a plurality of emission resistors for emitting droplets of ink, wherein said print-head further comprises a compensation resistor connected to said circuit and to one electrode of said pair of electrodes, to define in association with said resistivity of said volume of ink at least one extreme on a variation range of the ink level, comprised between a remaining minimum volume and a maximum volume of ink contained in said container between said pair of electrodes.

9. Apparatus according to claim 8 wherein said compensation resistor is connected to at least one resistor of said plurality of emission resistors and to said circuit.

10. Apparatus according to claim 8, wherein said compensation resistor is outside said print-head and is part of said circuit.

11. Apparatus according to claim 8, wherein said remaining minimum volume is comprised between 25% and 40% of said maximum volume of ink contained in said container.

* * * * *